US006108507A

United States Patent [19]

Chang et al.

[11] Patent Number: 6,108,507

[45] Date of Patent: Aug. 22, 2000

[54] INK SUPPLYING TECHNIQUE FOR IMAGE FORMING APPARATUS

[75] Inventors: Kee-son Chang; Jin-geun Kwak, both of Suwon, Rep. of Korea

[73] Assignee: SamSung Electronics Co., Ltd., Kyungki-do, Rep. of Korea

[21] Appl. No.: 09/342,185

[22] Filed: Jun. 29, 1999

[30] Foreign Application Priority Data

Jun. 30, 1998 [KR] Rep. of Korea ..... 98-25903

[51] Int. Cl.[7] ..... G03G 15/10

[52] U.S. Cl. ..... 399/237; 399/238

[58] Field of Search ..... 399/237, 57, 233, 399/238, 239, 246

[56] References Cited

U.S. PATENT DOCUMENTS 3,192,897 7/1965 Young ..... 399/239

3,651,782 3/1972 MacDonald, Jr. ..... 399/238 X 4,110,029 8/1978 Goshima et al. ..... 399/238

5,890,039 3/1999 Yoo ..... 399/238

*Primary Examiner*—Quana Grainger

*Attorney, Agent, or Firm*—Robert E. Bushnell, Esq.

[57] ABSTRACT

A technique for supplying ink in a liquid printer, for example, includes an apparatus containing: an ink reservoir containing ink; a supply pump for pumping ink into the ink reservoir; a manifold coupled to the supply pump via an ink supply pipe and through which ink is injected to a gap between a developing roller and a photoreceptor web, and an ink storing portion installed between the ink supply pipe and the manifold and having a sectional area greater than that of the ink supply pipe so that a change in pressure of ink supplied to the manifold from the ink supply pipe is minimized.

12 Claims, 5 Drawing Sheets

FIG. 1 *(Related Art)*

INK SUPPLYING TECHNIQUE FOR IMAGE FORMING APPARATUS

CLAIM OF PRIORITY

This application makes reference to, incorporates the same herein, and claims all benefits accruing under 35 U.S.C. §119 from my application *INK SUPPLYING APPARATUS FOR LIQUID TYPE PRINTER* filed with the Korean Industrial Property Office on Jun. 30, 1998 and there duly assigned Ser. No. 25903/1998.

BACKGROUND OF THE INVENTION

1. Field of the Invention

The present invention relates to a technique for supplying ink for an image forming apparatus, such as a liquid printer, which can uniformly supply ink across the entire width of a developing roller.

2. Description of the Related Art

In an image forming apparatus such as a liquid printer, includes a developing unit for developing an image on an electrostatic image area formed on a surface of a photoreceptor web using ink and an ink supplying apparatus for supplying ink to the developing unit.

The ink supplying apparatus includes an ink container containing ink of a predetermined color, a supply pump for pumping the ink into the ink container, a manifold through which the ink pumped by the supply pump is injected to a development gap formed between the developing roller and the photoreceptor web, and an ink supply pipe connected between the lower portion of the middle of the manifold and the supply pump.

In such an ink supplying apparatus, since the inner diameter of the ink supply pipe is smaller than an inner space of the manifold, a change in pressure is generated between the ink and the ink supply pipe and the ink supplied into the manifold. Such a difference in pressure causes the ink to be supplied mainly to the middle portion of the developing roller. Therefore, the concentration of ink on an image developed in the electrostatic latent image area by the developing roller becomes irregular, thus lowering the quality of the image.

SUMMARY OF THE INVENTION

To solve the above problem, it is an object of the present invention is to provide a technique for supplying ink in a liquid type printer, for example, having an improved structure so that the ink can be uniformly supplied across the entire width of a developing roller.

Accordingly, to achieve the above object, there is provided an apparatus for supplying ink comprising: an ink reservoir containing ink, a supply pump for pumping ink into the ink reservoir, a manifold coupled to the supply pump via an ink supply pipe and through which ink is injected to a gap between a developing roller and a photoreceptor web, and an ink storing portion disposed between the ink supply pipe and the manifold and having a sectional area greater than that of the ink supply pipe so that a change in pressure of ink supplied to the manifold from the ink supply pipe is minimized.

It is preferable in the present invention that the ink storing portion is provided in a lower portion of the manifold and a bottom surface thereof is formed so as to be slanted and the ink supply pipe is coupled to a side portion of the ink storing portion such that ink remaining in the manifold and the ink storing portion flows down due to gravity.

It is preferable in the present invention that the ink storing portion is provided in a lower portion of the manifold and a bottom surface thereof is formed so as to be slanted and the ink supply pipe is installed at a lower portion of the ink storing portion such that ink remaining in the manifold and the ink storing portion flows down due to gravity.

BRIEF DESCRIPTION OF THE DRAWINGS

A more complete appreciation of the invention, and may of the attendant advantages, thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
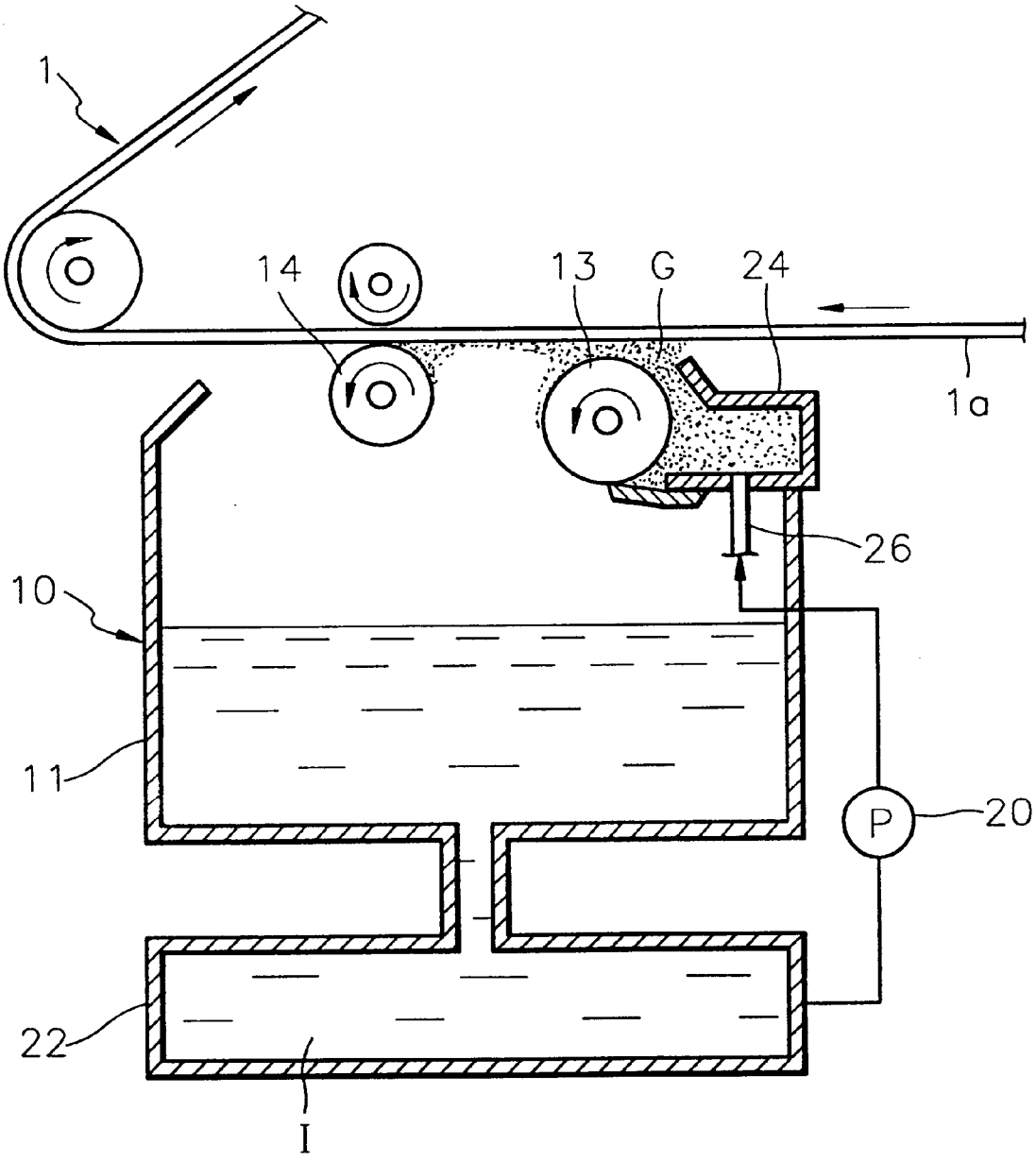
FIG. 1 is a schematic view showing an ink supplying apparatus.

An image forming apparatus, such as a liquid printer, e.g., a color laser printer, as shown in FIG. 1, includes a developing unit 10 for developing an image on an electrostatic latent image area 1*a* formed on a surface of a photoreceptor web 1 using ink and an ink supplying apparatus for supplying ink to the developing unit 10.

In a main body 11 of the developing unit 10, there is a developing roller 13 for developing ink supplied by the ink supplying apparatus in the electrostatic latent image area 1*a* of the photoreceptor web 1 and a squeeze roller 14 for squeezing liquid carrier from the developed ink by pressing the ink developed on the electrostatic latent image area 1*a*.

The ink supplying apparatus includes an ink container 22 containing ink I of a predetermined color, a supply pump 20 for pumping the ink into the ink container 22, a manifold 24 through which the ink pumped by the supply pump 20 is injected to a development gap G formed between the developing roller 13 and the photoreceptor web 1, and an ink supply pipe 26 connected between the lower portion of the middle of the manifold 24 and the supply pump 20.

However, in the ink supplying apparatus having the above structure, since the inner diameter of the ink supply pipe 26 is smaller than an inner space of the manifold 24, a change in pressure is generated between the ink in the ink supply pipe 26 and the ink supplied into the manifold 24. Such a difference in pressure causes the ink to be supplied mainly to the middle portion of the developing roller 13. Therefore, the concentration of ink on an image developed in the electrostatic latent image area 1*a* by the developing roller 13 becomes irregular, thus lowering the quality of the image.

Figure 2:
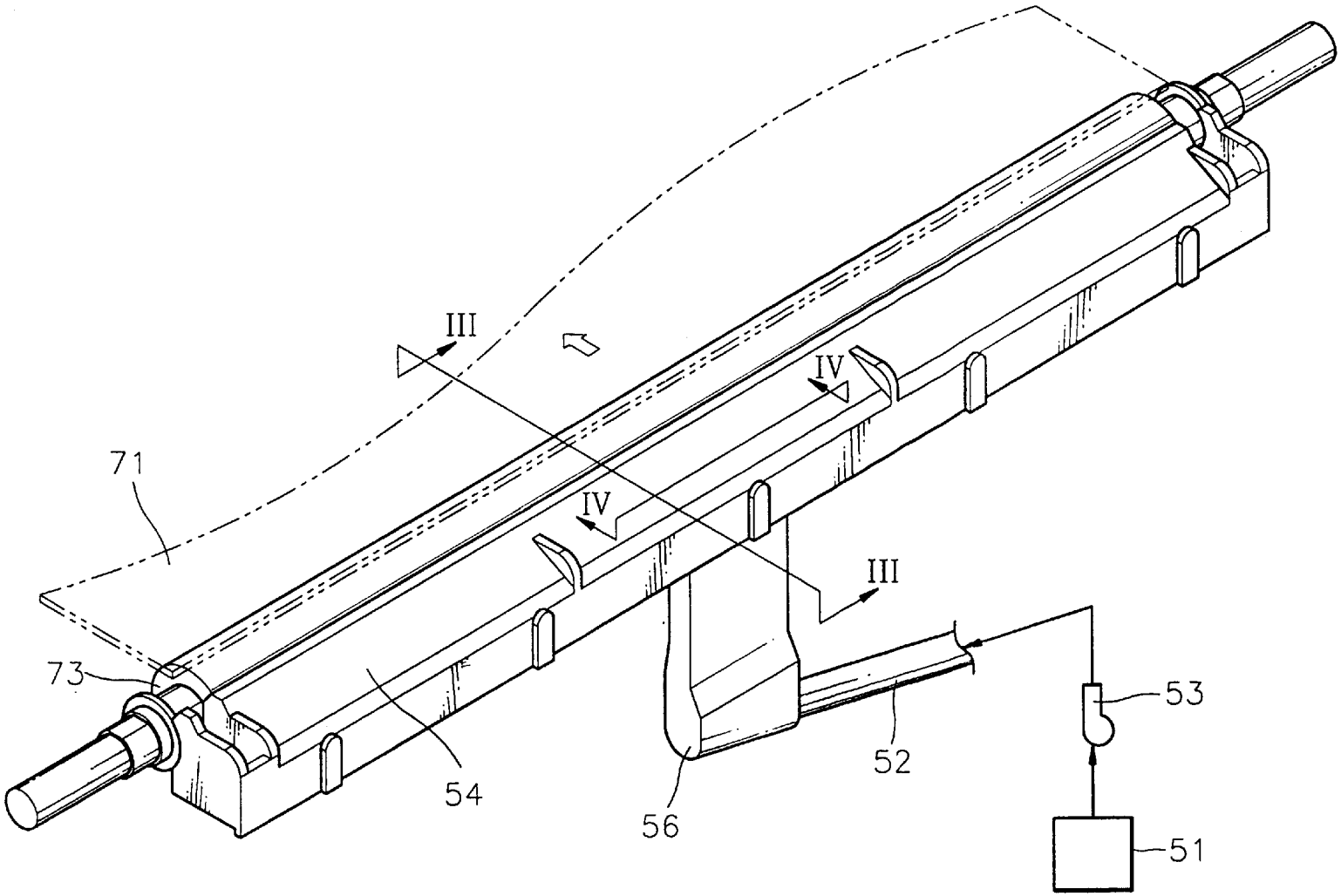
FIG. 2 is a perspective view showing an ink supplying apparatus according to a preferred embodiment of the present invention.

Referring to FIG. 2, an ink supplying apparatus for a liquid type printer, for example, according to a preferred embodiment of the present invention includes an ink reservoir 51 containing ink, a supply pump 53 for pumping the ink in the ink reservoir 51, a manifold 54 through which the ink pumped by the supply pump 53 is injected toward a predetermined development gap G between a photoreceptor web 71 and a developing roller 73, an ink supply pipe 52 for supplying ink from the supply pump 53 to the manifold 54, and an ink storing portion 56 installed in a lower portion of the manifold 54.

Figure 3:
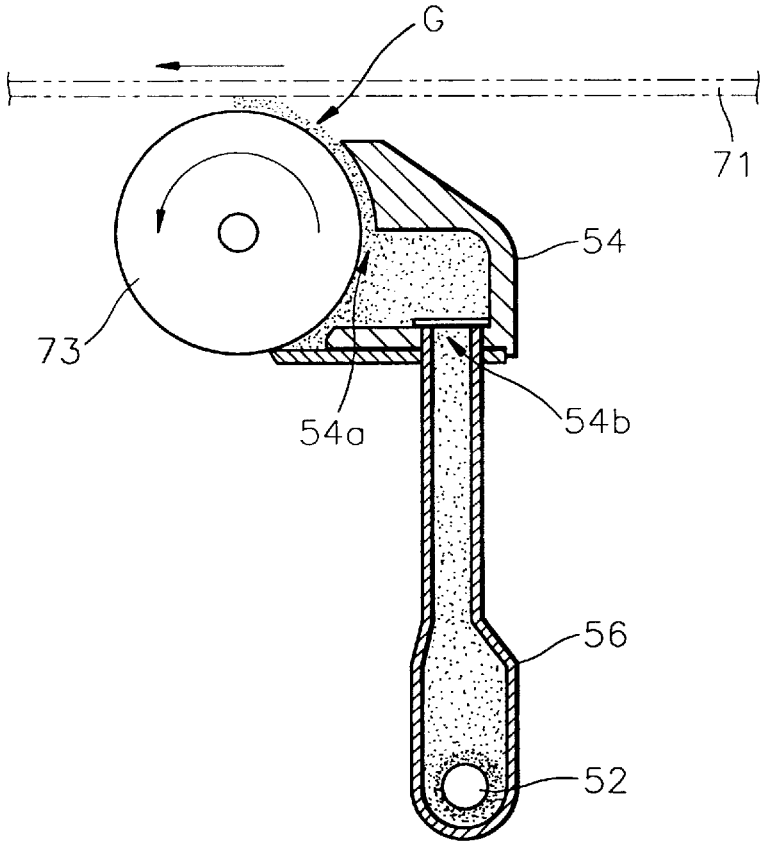
FIG. 3 is a sectional view taken along line III—III of FIG. 2.

As shown in FIG. 3, the manifold 54 includes an ink injection outlet 54*a* formed at a leading edge thereof to face the entire width of the developing roller 73 and an ink inlet 54*b* formed at a lower portion of the manifold 54.

Figure 4:
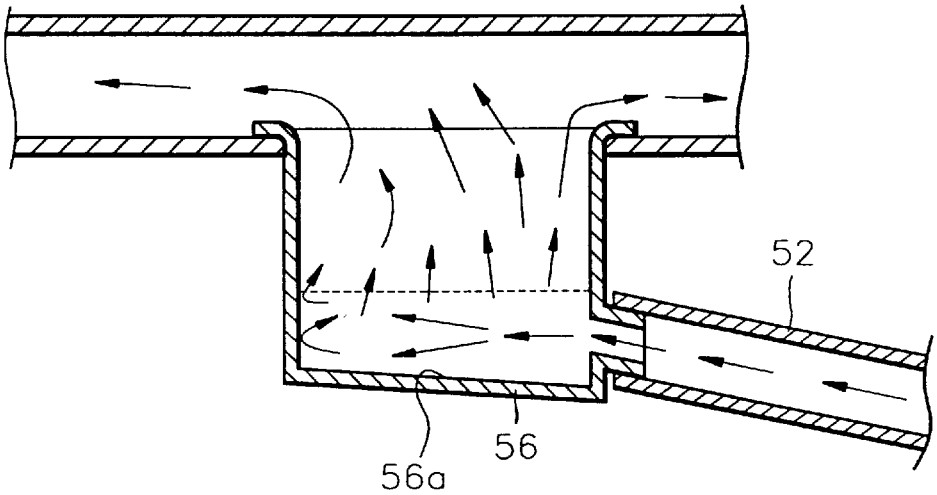
FIG. 4 is a sectional view taken along line IV—IV of FIG. 2.

The ink storing portion 56 is connected to the ink inlet 54*b* and the ink supply pipe 52 and stores a predetermined amount of ink. To preliminarily reduce pressure of the ink before being supplied to the manifold 54, the ink storing portion 56 has an inner space greater than the inner diameter of the ink supply pipe 52. Also, as shown in FIG. 4, a bottom surface 56*a* of the ink storing portion 56 is preferably formed to be slanted at a predetermined angle so that the ink remaining after the supply of ink is stopped can flow downward toward the ink supply pipe 52 due to the weight thereof.

Also, the ink supply pipe 52 is preferably connected to the side portion of the ink storing portion 56 to be slanted at an angle greater than that of the bottom surface 56*a* of the ink storing portion 56 so that the ink remaining in the ink supply pipe 52 and the ink storing portion 56 flow smoothly.

The operation of the ink supplying apparatus according to a preferred embodiment of the present invention will be described as follow.

When the ink in the ink reservoir 51 is pumped by the supply pump 53 with high pressure, the pressure of ink pumped is preliminarily reduced in the ink supply pipe 52 before it is supplied to the manifold 54. The pressure of the ink in the ink storing portion 56 is secondarily reduced as it is supplied to the inside of the manifold 54. Thus, the difference in pressure of the ink supplied to the manifold 54 from the ink reservoir 51 is decreased so that the ink is uniformly distributed inside the manifold 54. The ink supplied to the manifold 54 is uniformly injected across the entire width of an outer circumferential surface of the developing roller 73 through the ink injection outlet 54*a*. Consequently, an image of uniform concentration can be formed on an electrostatic latent image area of the photoreceptor web 71.

When the development operation is completed and the supply of ink is stopped, the ink remaining in the ink storing portion 56 and the ink supply pipe 52 is collected in the ink reservoir 51 as it flows on the slanted bottom surface 56*a* of the ink storing portion 56 and the ink supply pipe 52.

Figure 5:
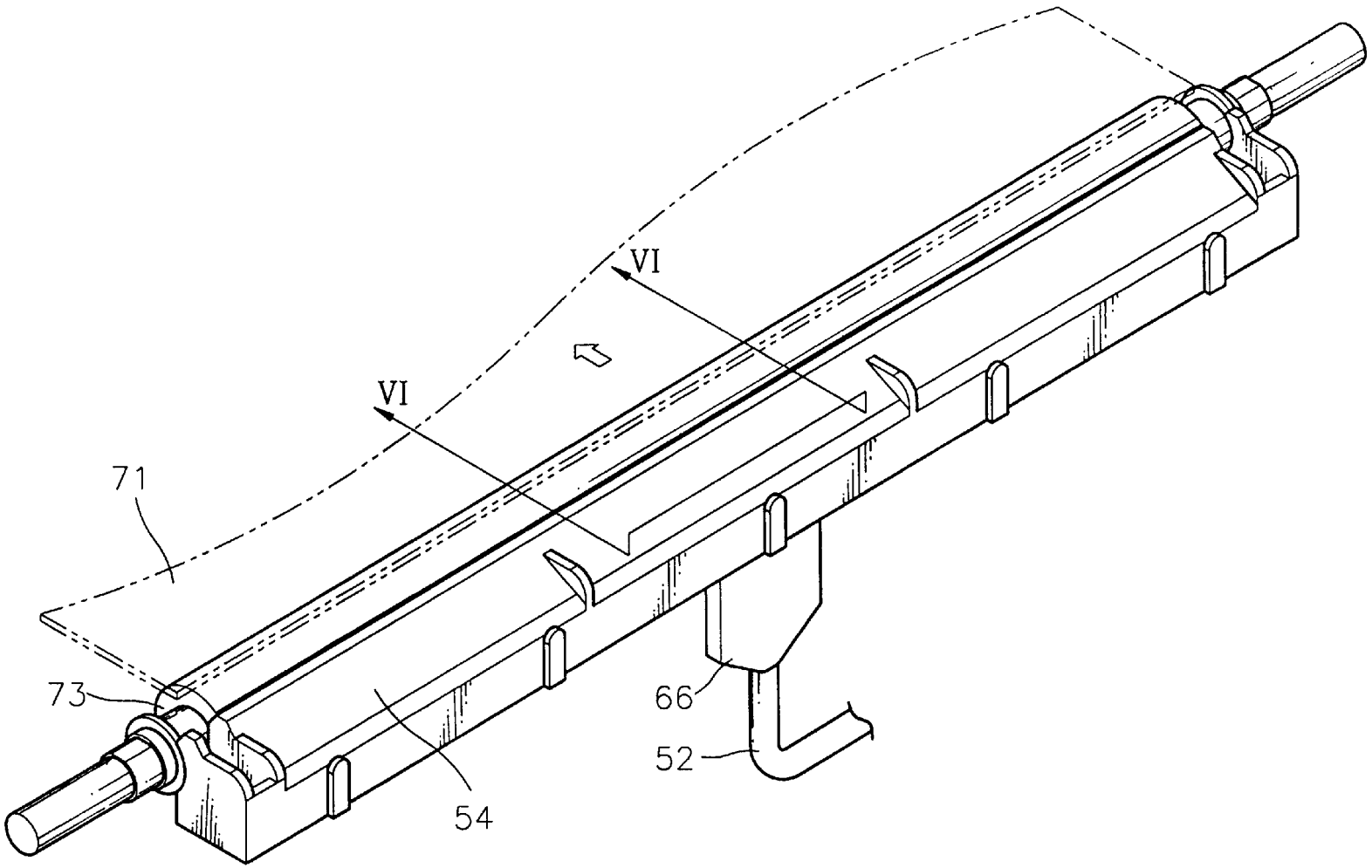
FIG. 5 is a perspective view showing an ink supplying apparatus according to another preferred embodiment of the present invention.
Figure 6:
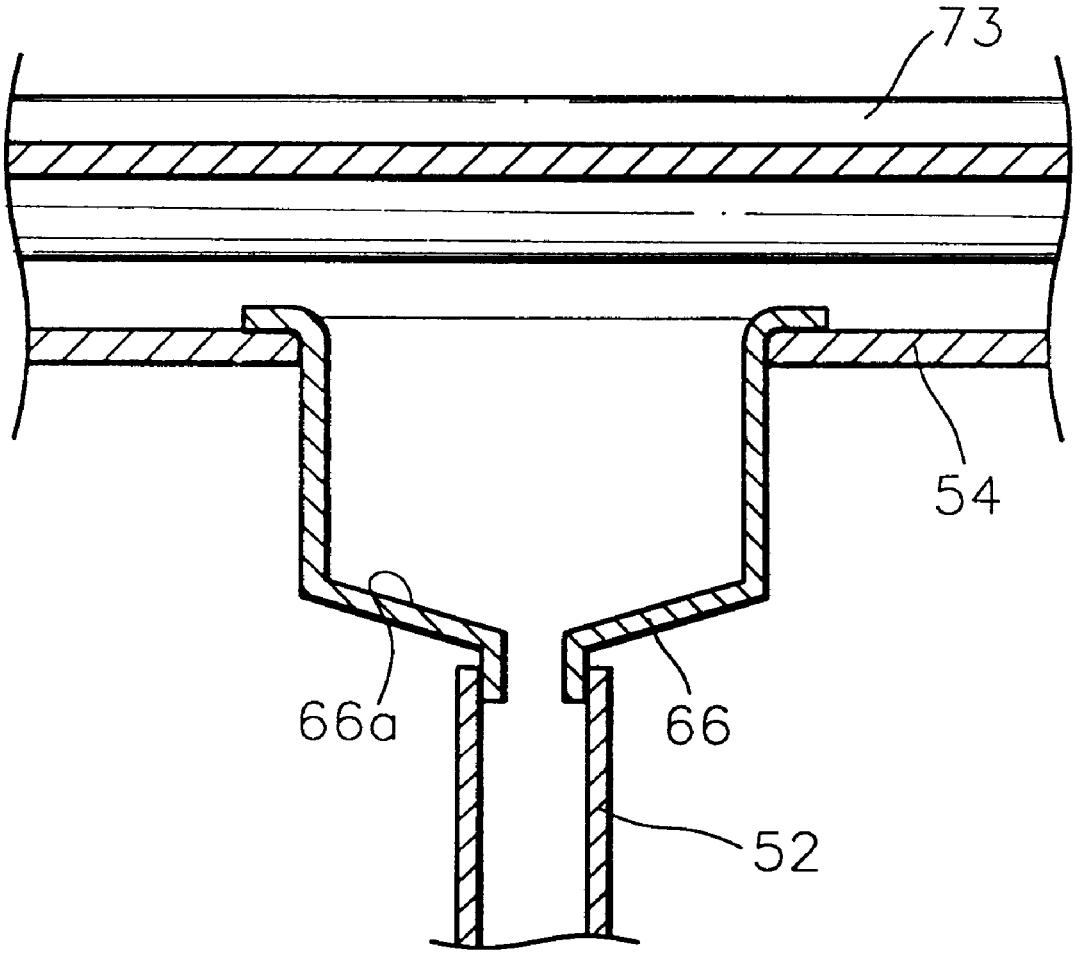
FIG. 6 is a sectional view taken along line VI—VI of FIG. 5.

FIGS. 5 and 6 show an ink supplying apparatus according to another preferred embodiment of the present invention. The elements having the same reference numerals as those described with reference to FIGS. 2 through 4 have the same functions. As shown in FIGS. 5 and 6, this embodiment is characteristic in that a bottom surface 66*a* of an ink storing portion 66 is inclined toward the central portion thereof to facilitate collection of the remaining ink and that the ink supply pipe 52 is coupled to a bottom portion of the ink storing portion 66.

It is noted that the present invention is not limited to the preferred embodiments described above, and it is apparent that variations and modifications by those skilled in the art can be effected within the spirit and scope of the present invention as defined in the appended claims.

What is claimed is:

1. An apparatus for supplying ink, the apparatus comprising:

an ink reservoir containing ink;

a supply pump for pumping ink from said ink reservoir;

a manifold coupled to said supply pump via an ink supply pipe and through which ink is injected to a gap between a developing roller and a photoreceptor web; and an ink storing portion disposed between said ink supply pipe and said manifold and having a sectional area greater than that of said ink supply pipe so that a change in pressure of ink supplied to said manifold from said ink supply pipe is minimized.

2. The apparatus as claimed in claim 1, said ink storing portion being disposed in a lower portion of said manifold and a bottom surface thereof being formed so as to be slanted and said ink supply pipe being coupled to a side portion of said ink storing portion such that ink remaining in said manifold and said ink storing portion flows down due to gravity.

3. The apparatus as claimed in claim 1, said ink storing portion being disposed in a lower portion of said manifold and a bottom surface thereof being formed so as to be slanted and said ink supply pipe being disposed at a lower portion of said ink storing portion such that ink remaining in said manifold and said ink storing portion flows down due to gravity.

4. An apparatus for supplying liquid, the apparatus comprising:

a liquid reservoir containing a liquid;

a supply pump for pumping liquid from said liquid reservoir;

a manifold coupled to said supply pump via a liquid supply pipe and through which liquid is injected to a gap between a roller and a web; and a liquid storing portion disposed between said liquid supply pipe and said manifold and having a sectional area greater than that of said liquid supply pipe so that a change in pressure of liquid supplied to said manifold from said liquid supply pipe is minimized.

5. The apparatus as claimed in claim 4, said liquid storing portion being disposed in a lower portion of said manifold and a bottom surface thereof being formed so as to be slanted and said liquid supply pipe being coupled to a side portion of said liquid storing portion such that liquid remaining in said manifold and said liquid storing portion flows down due to gravity.

6. The apparatus as claimed in claim 4, said liquid storing portion being disposed in a lower portion of said manifold and a bottom surface thereof being formed so as to be slanted and said liquid supply pipe being disposed at a lower portion of said liquid storing portion such that liquid remaining in said manifold and said liquid storing portion flows down due to gravity.

7. A method of supplying ink, the method comprising the steps of:

storing ink in an ink reservoir;

pumping ink from said ink reservoir with a supply pump;

injecting ink to a gap between a developing roller and a photoreceptor web with a manifold coupled to said supply pump via an ink supply pipe; and storing ink in an ink storing portion disposed between said ink supply pipe and said manifold and having a sectional area greater than that of said ink supply pipe so that a change in pressure of ink supplied to said manifold from said ink supply pipe is minimized.

8. The method as claimed in claim 7, further comprising disposing said ink storing portion in a lower portion of said manifold and forming a bottom surface thereof so as to be slanted and coupling said ink supply pipe to a side portion of said ink storing portion such that ink remaining in said manifold and said ink storing portion flows down due to gravity.

9. The method as claimed in claim 7, further comprising disposing said ink storing portion in a lower portion of said manifold and forming a bottom surface thereof so as to be slanted and coupling said ink supply pipe at a lower portion of said ink storing portion such that ink remaining in said manifold and said ink storing portion flows down due to gravity.

10. A method of supplying liquid, the method comprising the steps of:

storing liquid in an liquid reservoir;

pumping liquid from said liquid reservoir with a supply pump;

injecting liquid to a gap between a roller and a web with a manifold coupled to said supply pump via an liquid supply pipe; and storing liquid in an liquid storing portion disposed between said liquid supply pipe and said manifold and having a sectional area greater than that of said liquid supply pipe so that a change in pressure of liquid supplied to said manifold from said liquid supply pipe is minimized.

11. The method as claimed in claim 10, further comprising disposing said liquid storing portion in a lower portion of said manifold and forming a bottom surface thereof so as to be slanted and coupling said liquid supply pipe to a side portion of said liquid storing portion such that liquid remaining in said manifold and said liquid storing portion flows down due to gravity.

12. The method as claimed in claim 10, further comprising disposing said liquid storing portion in a lower portion of said manifold and forming a bottom surface thereof so as to be slanted and coupling said liquid supply pipe at a lower portion of said liquid storing portion such that liquid remaining in said manifold and said liquid storing portion flows down due to gravity.

* * * * *